US005193497A

United States Patent [19]

Hakansson

[11] Patent Number: 5,193,497

[45] Date of Patent: Mar. 16, 1993

[54] VALVE ARRANGEMENT

[75] Inventor: Olof Hakansson, Stenkullen, Sweden

[73] Assignee: AB Volvo, Sweden

[21] Appl. No.: 852,247

[22] PCT Filed: Nov. 28, 1990

[86] PCT No.: PCT/SE90/00784

§ 371 Date: Jun. 30, 1992

§ 102(e) Date: Jun. 30, 1992

[87] PCT Pub. No.: WO91/08381

PCT Pub. Date: Jun. 13, 1991

[30] Foreign Application Priority Data

Dec. 1, 1989 [SE] Sweden ..... 8904060

[51] Int. Cl.[5] ..... F01L 1/24

[52] U.S. Cl. ..... 123/90.16; 123/90.33; 123/90.36; 123/90.46

[58] Field of Search ..... 123/90.12, 90.13, 90.15, 123/90.16, 90.33, 90.36, 90.45, 90.46

[56] References Cited

U.S. PATENT DOCUMENTS

| | | | |
|---|---|---|---|
| 3,439,661 | 4/1969 | Weiler | 123/90.16 |
| 4,150,640 | 4/1979 | Egan | 123/90.15 |
| 4,258,671 | 3/1981 | Takizawa et al. | 123/90.16 |
| 4,423,712 | 1/1984 | Mayne et al. | 123/90.15 |
| 4,452,187 | 6/1984 | Kosuda et al. | 123/90.16 |
| 4,466,390 | 8/1984 | Babitzka et al. | 123/90.16 |
| 4,497,307 | 2/1985 | Paar et al. | 123/90.33 |
| 4,523,551 | 6/1985 | Arai et al. | 123/90.36 |
| 4,554,895 | 11/1985 | Ono | 123/90.46 |
| 4,644,914 | 2/1987 | Morita et al. | 123/90.36 |
| 4,646,690 | 3/1987 | Hayashi | 123/90.46 |
| 4,696,265 | 9/1987 | Nohira | 123/90.16 |
| 4,796,573 | 1/1989 | Wakeman et al. | 123/90.16 |
| 4,924,821 | 5/1990 | Teerman | 123/90.46 |

FOREIGN PATENT DOCUMENTS

| | | | |
|---|---|---|---|
| 0212981 | 3/1987 | European Pat. Off. . | |
| 0269605 | 6/1988 | European Pat. Off. . | |
| 3619957 | 12/1987 | Fed. Rep. of Germany . | |
| 8902695 | 8/1989 | Fed. Rep. of Germany . | |
| 88411 | 5/1983 | Japan | 123/90.46 |
| 23010 | 2/1984 | Japan | 123/90.36 |
| 2138093 | 10/1984 | United Kingdom . | |

OTHER PUBLICATIONS

W. J. Polizzoni, "Dyntard . . . Mack's New Engine Brake", Feb. 15, 1971 in *Automotive Industries* on pp. 49–50, vol. 144, No. 4.

*Primary Examiner*—E. Rollins Cross
*Assistant Examiner*—Weilun Lo
*Attorney, Agent, or Firm*—Lerner, David, Littenberg, Krumholz & Mentlik

[57] ABSTRACT

A device for taking up valve clearance in the valve mechanism of an internal combustion engine, which mechanism includes rocker arms arranged on at least one rocker arm shaft. The take-up occurs by means of an actively adjustable, hydraulically operated take-up means operable between two positions, i.e., a withdrawn position and an extended position, which take-up means is arranged at the operating end of the rocker arms whose valve clearance is to be taken up. The hydraulic pressure for operating the take-up means is achieved by a somewhat increased lubrication pressure in the rocker arm shaft for this type of engine, which pressure for said extension of the take-up means is increased by wholly or partially blocking the normal drainage of the oil.

6 Claims, 1 Drawing Sheet

VALVE ARRANGEMENT

TECHNICAL FIELD

The present invention relates to a device for controlling the take-up of valve clearance in the valve mechanism of an internal combustion engine, comprising, on the one hand, a rocker arm system with at least one typically hollow-formed rocker arm shaft and, on the other hand, a hydraulically operated take-up means arranged in connection with the operating end of those valves whose valve clearance is to be taken up, whereby each valve's rocker arm has a conduit for the supply of oil to the take-up means, and the drainage of the oil fed to the rocker arm shaft and thence to the rocker arms and respective take-up means is arranged such that only a small quantity of the oil, i.e. that which is necessary for the bearing surfaces of the rocker arms, is drained via normal leakage flow between the rocker arms and their shaft.

BACKGROUND AND PROBLEM

Known devices for valve clearance take-up have up until now above all been used specially for this purpose, that is the take-up of clearance, both so as to achieve a quieter running of the engine and to reduce the stresses therein. Such a device is known, for example, from GB-A-2 138 093.

The ever growing demands over the last few years for more effective auxiliary braking systems on commercial vehicles has led to ever more advanced solutions to satisfy the demands. One of these is described in Swedish patent application 8900517-7 (and WO-A-90/09514). According to this document the camshaft of the engine's valve system is used to obtain negative work from the engine instead of positive work which it is normally intended to achieve. This is achieved with the aid of extra lobes on the camshaft which open a connection between the engine's combustion chambers and its exhaust system during the latter portion of the inlet stroke (four-stroke motor) and by closing this connection at the first portion of the corresponding compression stroke. In this way, a large portion of the compression work is lost as braking. The said additional lobes on the camshaft are so small that in terms of size they fall into the category which can be called normal clearance in an engine of this type. Another engine-braking device is described in EP-A-0 269 605 in which valve clearance take up means are located in a recess in the cylinder-head of an internal combustion engine directly beneath the end of the rocker arm remote from the valve stem.

Known methods and devices for actively adjustable valve clearance take-up include separate systems for the activation and de-activation, controlled either by electrical systems or by separate hydraulic systems No matter which type is chosen, a relatively high grade of complexity is required, particularly with the implementation of a separate hydraulic system. In addition to the fact that this means almost a doubling of the number of hydraulic components in the valve system, a result thereof is the reduced reliability and a larger production cost per unit.

SOLUTION

A principal object of the present invention is to provide device whereby the engine's existing pressurized oil system is used in order to guarantee the above mentioned function with minimal modification using essentially already existing components.

At the same time it is an object to facilitate a comparatively lower production cost per unit with maintained or improved reliability of the function by means of said optimisation of the use of the engine's existing components.

ADVANTAGES

Practical trials have shown that, with the invention described by way of introduction, exceedingly good operation in all respects is achieved. The device according to the invention is characterized in that a quantity of the oil fed to the rocker arm shaft is drained from the rocker arm shaft back to the engine oil reservoir via a specially arranged conduit having an outlet orifice, and in that a pneumatically or mechanically operable piston-cylinder unit is arranged close to said outlet orifice to effect closing of said orifice, thereby causing an increase in the pressure in the rocker arm shaft and associated rocker arms so that the take-up means extends.

An advantage with the invention is that additional machineing or assembling of oil conduits can, in the main, be avoided on a so called base engine with which at the start of production it is not yet known whether the engine will definitely be equipped with actively controlled valve clearance or not.

BRIEF DESCRIPTION OF THE DRAWINGS

The invention will be described in the following in more detail with reference to a preferred embodiment and attached drawings in which

In FIG. 1 a valve mechanism 1 for an (not shown) internal combustion engine is schematically shown. The mechanism 1 includes a camshaft 2 which, via a cylindrical roller 3, transmits its rotational movement to a rocker arm 4. The rocker arm 4 is arranged on a hollow rocker arm shaft 5 which is intended to be mounted to a cylinder head (not shown) by means of bolts (not shown). The rotational movement is imparted to the camshaft by conventional means via a transmission from the engine's crank shaft (not shown). From the figures it can be seen that the rocker arm 4, via means 6 and a hemispherical guide 7 thereon, acts directly on a yoke 8 which is moveable up and down on a guide S in the cylinder head. The yoke 8 acts in turn on two valve stems 9 on whose ends, in a conventional way, valve heads (not shown) are arranged. Each rocker arm 4 accordingly operates two valves which simultaneously move up and down. In order for this to be possible, each valve stem 9 is surrounded by a valve spring 10, which, in a conventional manner with the aid of a locking means and a washer (not shown) on each one, is held in a controlled position against the valve's closed position.

Figures 1, 2:
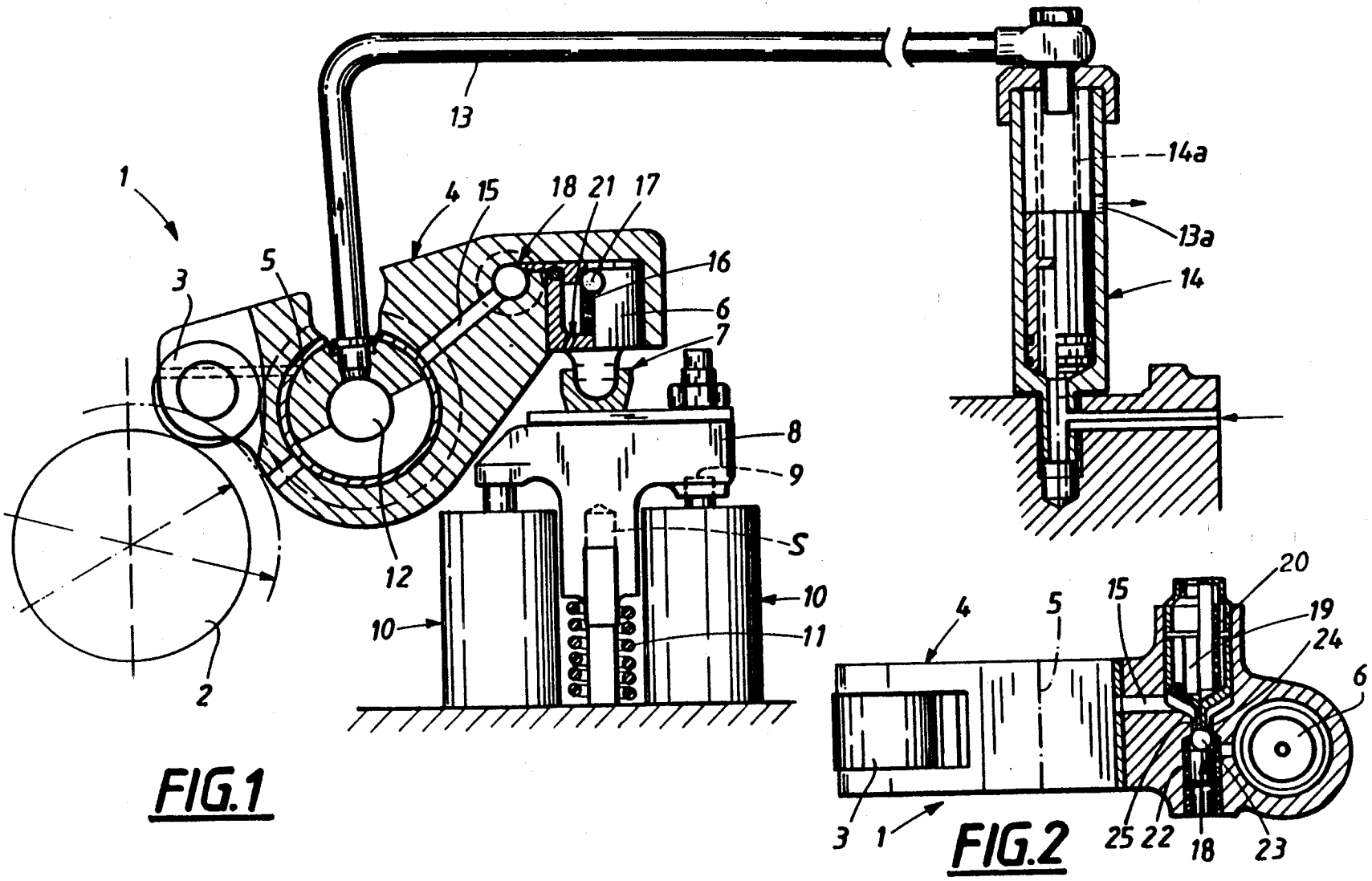
FIG. 1 shows an internal combustion engine's valve mechanism with a device for valve clearance take-up according to the invention.
FIG. 2 shows a rocker arm according to FIG. 1 seen n partial cross-section as it is mounted in an engine, seen from above.

In addition to both the valve springs 10, there is a spring 11 which is arranged beneath the yoke 8. The purpose of this spring is to maintain the yoke 8 in such a position that the clearance which always arises in a valve mechanism of this type occurs between the respective valve stems 9 and the underside of the yoke 8. The spring 11 has a further purpose which will be referred to in more detail below. The described valve mechanism is pressure lubricated by oil which is supplied via conduits in the cylinder block and cylinder head of the engine to the hollow interior of the rocker arm shaft 5. The plain bearings of the rocker arms 4 are lubricated by a certain leakage flow between the shaft 5 and the bearings. Under normal circumstances this is, however, not large and a drainage of a portion of the lubricant also occurs via a special conduit 13. According to the invention, a pneumatically, or alternatively mechanically, operated piston-cylinder device 14 is introduced into the return conduit 13, which device during normal operation maintains the oil pressure at a predetermined low value by means of the resiliency of a spring 14*a* which facilitates the drainage of the oil to the lubricant reservoir via an outlet 13*a* and which, when activated, prevents the pressure oil from being drained via the outlet 13*a*. The only remaining outlet for the oil after activation is hereby between the shaft 5 and the plain bearings (according to the above), whereby a considerable pressure increase is achieved to a pressure in the oil approaching the engine's feed pressure. Since the oil is also fed to the working end of the rocker arm 4 via a conduit 15 and to the means 6 arranged there, the following occurs; the means 6 which in principle is of piston cylinder type is activated and as soon as the pressure in the means 6 climbs to such a level that it overcomes the force of the spring 11 it will act as a clearance take-up means. The force from the means 6 is however never so large that it can affect any of the valve stems 9.

For the sake of safety, as can be seen in FIG. 1, the means 6 also has a ball valve 17 influenced by a spring 16. This valve assures that the oil pressure can never become too high in the cavity at the means 6 so that various components in the valve system become damaged. In the event that the valve 17 opens, the oil is drained back to the motor via one or more conduits 21 via normal drainage in the engine back to the engine's lubrication reservoir.

In FIG. 2 the rocker arm 4 is shown in partial section, as mentioned earlier. In addition, it can be seen that the oil in the oil conduit 15 must pass through a check valve arrangement 18 before it reaches the means 6. The purpose of this arrangement is that, during operation of the engine without valve clearance according to the earlier description, "pumping" is prevented, which means that the pressure from the springs and other valve forces should give a return pressure in the conduit 15. The check valve is of the spring/ball type 22 resp. 23 and solves the pumping problem. The check valve arrangement 18 does however prevent the overriding of the operation of the valve take-up means 6 when so desired. In order for this to be able to occur, a piston 19 is arranged in a cylinder right behind the ball bearing 23 of the check valve arrangement 18, which piston has a plunger-shaped prong 24 at its end towards the ball bearing which, at low oil pressure, presses the ball bearing from its seat under the influence of a spring 20. The plunger-shaped prong 24 extends in a tubular conduit 25 which, despite the prong 24, permits a flow of oil in both directions. At high pressure, the piston's 19 effect on the ball bearing is overcome since the spring 20 cannot overcome the oil pressure on the end of the piston 19 provided with the prong.

Naturally the invention is not restricted to the above described embodiment, and changes can be made within the scope of the appended claims. By way of example, the piston-cylinder arrangement 14 can be dimensioned such that during operation it gives a temporarily increased back pressure in the drainage conduit whereby a faster clearance take-up is achieved.

I claim:

1. A device for controlling a take-up of valve clearance in a valve mechanism of an internal combustion engine, comprising a rocker arm system with at least one typically hollow-formed rocker arm shaft and a hydraulically operated take-up means arranged in connection with operating ends of valves whose valve clearances are to be taken up, whereby each rocker arm has a conduit for a supply of an oil to the take-up means, and a drainage of the oil fed to the rocker arm shaft and thence to the rocker arms and respective take-up means is arranged such that only a small quantity of the oil which is necessary for the bearing surfaces of the rocker arms, is drained via normal leakage flow between the rocker arms and their shaft, characterized in that a quantity of the oil fed to the rocker arm shaft is drained from the rocker arm shaft back to the engine oil reservoir via a specially arranged conduit having an outlet orifice, and in that a pneumatically or mechanically operable piston-cylinder unit is arranged close to said outlet orifice to effect closing of said orifice, thereby causing an increase in the pressure in the rocker arm shaft and associated rocker arms so that the take-up means extends.

2. The device according to claim 1, characterized in that it has an operating plunger/check valve arrangement which is arranged so that at low pressure in the conduit return flow of oil from the take-up means is permitted and at high pressure in the conduit said return flow is prevented.

3. The device according to claim 2, characterized in that the operating plunger/check valve arrangement has two components, each acted upon by a spring, a plunger piston and a ball bearing, said components being opposed so that when no oil pressure forces act on the arrangement, the spring of the plunger can cancel the action of the spring of the ball bearing.

4. The device according to claim 3, characterized in that the plunger piston is substantially cylindrical except for its end region facing the ball bearing which is formed into a thin plunger-shaped prong connected to the cylinder body in the direction of its sleeve.

5. The device according to claim 4, characterized in that the action between the plunger piston and the ball bearing occurs via a narrow tubular conduit which, in addition to said plunger prong, also permits a flow of oil in both directions.

6. The device according to claim 5, characterized in that the tubular conduit's one end is shaped as a sealing valve-seat for the ball bearing.

* * * * *